US005244270A

United States Patent [19]

Parker

[11] Patent Number: 5,244,270

[45] Date of Patent: Sep. 14, 1993

[54] KITCHEN WASTE RECYCLING CAROUSEL

[76] Inventor: Michael S. Parker, Route 185 Box 200, Sorrento, Me. 04677

[21] Appl. No.: 808,622

[22] Filed: Dec. 16, 1991

[51] Int. Cl.[5] ..... A47B 51/00

[52] U.S. Cl. ..... 312/270.2; 312/212; 312/305

[58] Field of Search ..... 312/270.2, 270.1, 270.3, 312/305, 311, 211, 212, 319.2

[56] References Cited

U.S. PATENT DOCUMENTS

| | | | |
|---|---|---|---|
| D. 319,126 | 8/1991 | Blackman | D34/7 |
| 812,343 | 2/1906 | Horner | 312/270.2 |
| 1,559,705 | 11/1925 | Jackson | 312/205 X |
| 2,025,416 | 12/1935 | Limerick, Jr. | 312/305 |
| 2,444,125 | 6/1948 | Wheeler | 312/270.2 |
| 2,644,737 | 7/1953 | Davis | 312/212 |
| 2,679,446 | 5/1954 | Weil | 312/270.2 |
| 3,648,875 | 3/1972 | Lundgren | 220/1 T |
| 3,904,218 | 9/1975 | Kostic | 280/79.2 |
| 4,120,548 | 10/1978 | Manor | 312/270.2 |
| 4,181,037 | 1/1980 | Boon et al. | 312/305 |
| 4,443,885 | 2/1984 | Baker | 312/305 |
| 5,013,102 | 5/1991 | Loblein | 312/234.1 |

FOREIGN PATENT DOCUMENTS

| | | | |
|---|---|---|---|
| 3038170 | 3/1982 | Fed. Rep. of Germany | 312/270.2 |

OTHER PUBLICATIONS

Rotary Recycling Center, five pages published by Feeny Manufacturing Co. and undated.

*Primary Examiner*—Victor N. Sakran
*Attorney, Agent, or Firm*—Abbott Spear

[57] ABSTRACT

A carousel for installation in an under-the-counter cabinet has a post to be rotatably supported by the base of the cabinet and the undersurface of the counter rearwardly of a door. An assembly of radial arms is secured to the upper part of the post. Each two adjacent arms are for use in holding the upper end of an appropriately dimensioned open container against lateral movement with the bottoms of the containers seated on supporting structure. Covers for the containers are pivotally connected to the assembly and each is dimensioned and disposed to close the open end of a subjacent container. The bottom ends of the containers are held by the structure against movements other than tilting movements. When the upper end of one of them is tilted forwardly towards the doorway to the extent permitted by a releasable connection between the cover and the container. The cover and the container are then so separated that the container is now open to receive designated waste material. The bottom of the container is seated on the periphery of the supporting structure in a position holding it from slipping rearwardly. The container may be removed by detaching its connection with the cover.

13 Claims, 7 Drawing Sheets

FIG.3
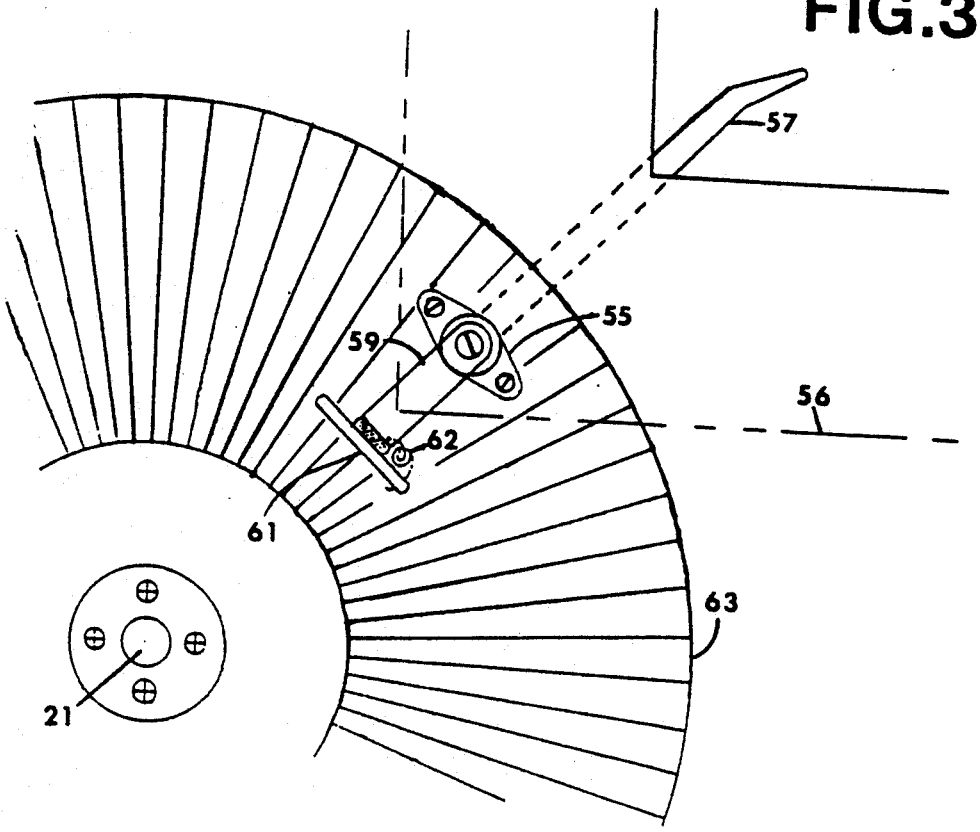
FIG. 5
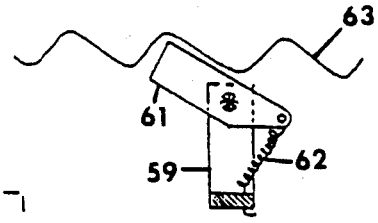
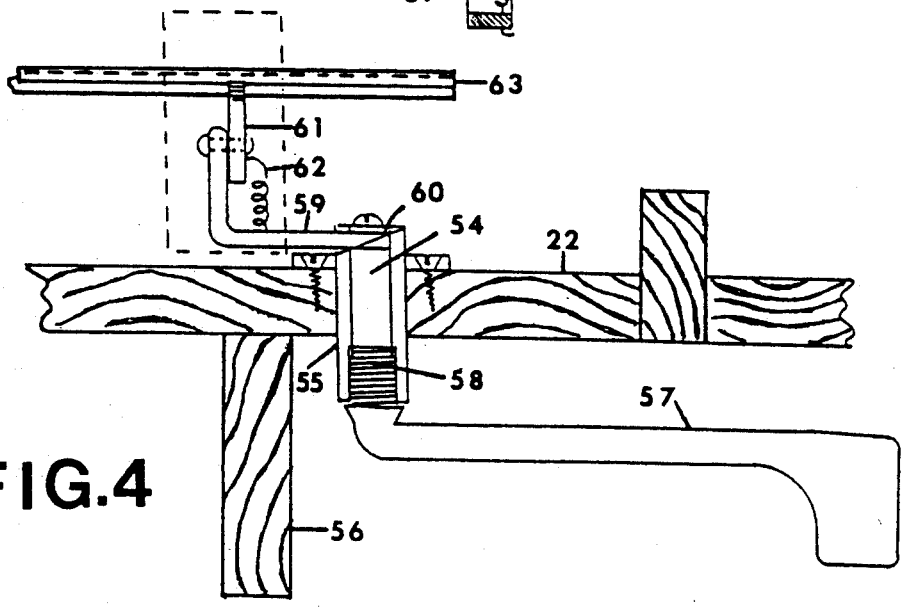
FIG.4

35A
27A
27
30A
43
40
31
39
37
30
35B
35
27A
27
34
34D
34C
33
34A
34B
29
35B
37
35A
35
38
33B
33
33A
34
28
27
26
25
29

KITCHEN WASTE RECYCLING CAROUSEL

BACKGROUND OF THE INVENTION

As problems attendant trash disposal have increased so have requirements become more widely established that household wastes be separated to facilitate recycling programs.

Much household waste originates in the kitchen and a generally preferred location for containers for such wastes is under a kitchen counter, usually in a corner thereof. Rotary container holders such as carousels have been proposed for such use.

Carousels proposed by prior art patents for installation in cabinets located under counters have rotatable posts provided with container supporting structures. In one type of carousel, the container supporting structure includes vertically spaced shelves with the containers easily removed through the doorway of the cabinet but of a capacity inadequate for trash storage. In another type of carousel, the containers, while of a height sufficient to provide a capacity adequate for trash storage, and dimensioned to pass through the doorway of the carousel, require a port opening through the counter in a location overlying the path of the containers as the post is turned in order to enable the material to be disposed to be entered in the appropriate container.

SUMMARY OF THE INVENTION

In accordance with the present invention, a carousel installed in a cabinet under a counter and having a normal closed doorway has a post rotatably supported by the base and top of the cabinet. An assembly, provided with arcuately spaced arms, is secured to the upper portion of the post. Each two adjacent arms are disposed to accommodate and hold between them the upper portion of an open container shaped and dimensioned to fit between them with the container bottom resting on supporting structure. The bottom of each container and the supporting structure are formed with portions in engagement which hold the container bottoms against lateral movements and which remain engaged when a container is tilted outwardly.

In a 90° base installation, the doorway is closed by a door which is right angular in cross section and is connected to one of the pairs of arms. When the post is turned to place the door under the counter, a container is partly exposed in the doorway so that it may have waste deposited in it. In other under-the-counter installations, the doors are connected by hinges to the cabinets and no container is similarly exposed on the opening of the door.

In accordance with the invention, provision is made to enable, in any under-the-counter carousel installation to be tilted outwardly by pulling forwardly the upper part of the container in the doorway with its bottom held against sliding rearwardly with the exposed area of its open end greatly increased. After receiving trash material, the tilted container is easily pushed back into its upright position.

For most uses, covers for the containers are wanted and each cover is pivotally connected to the arm assembly to fit over and close the open end of a subjacent container and has a depending lug near its outer end. The lug is dimensioned to enter the container. When the upper end of the closed container is pulled forwardly, the container tilts as its bottom is held and the tilting continues until the rearward end of the container engages the lug. The container is then not only held tilted but also has its open end almost completely uncovered. The container may then be removed from the carousel by lifting the cover to withdraw its lug from the container permitting the container to be tilted further outwardly and lifted from the carousel.

The invention also enables the carousels to be used with shorter containers by providing shelves each of which can be detachably attached to the post in any vertical position underlying a pair of arms of the assembly. Such a tray and the space below may be used to hold various articles. One important use is the support of a garbage container on a tray with a cover to be opened and closed in much the same manner as those of maximum height, the difference being that the bottom of the garbage container must permit it to be slid forwardly before being tilted so that the rear thereof will pass through the doorway.

Various other novel features and advantages of the invention will be apparent from the accompanying drawings, the following specification and the claims.

BRIEF DESCRIPTION OF THE DRAWINGS

The accompanying drawings illustrate presently preferred embodiments of the invention of which

FIG. 3 is a fragmentary and somewhat schematic view of the radially corrugated pan axially fixed on the post and the mechanism by which the post can be turned by foot engagement with an arm exposed at the kick plate;

FIG. 4 is a partly sectioned sideview of the mechanism;

FIG. 5 is a fragmentary side view of the pawl;

THE PREFERRED EMBODIMENTS

Figure 17:
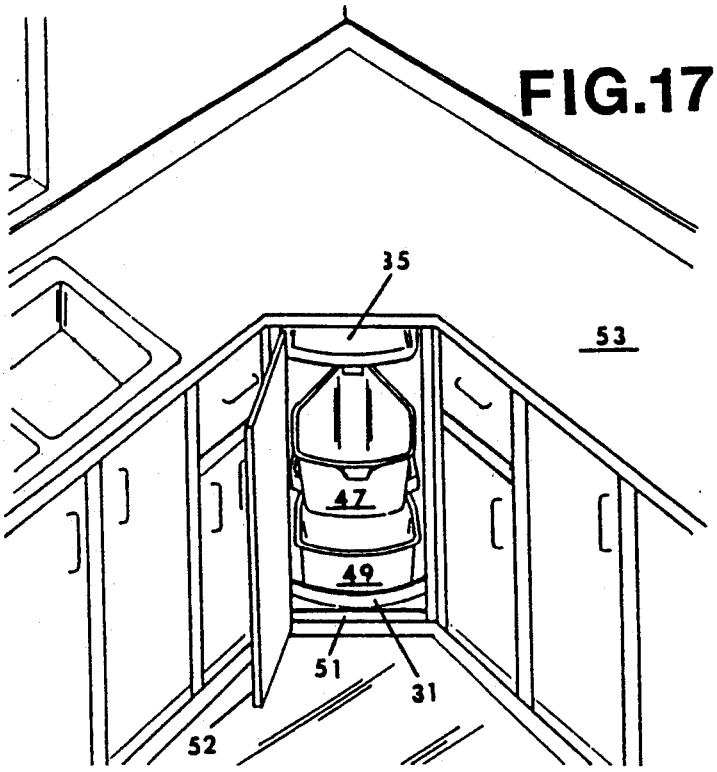
FIG. 17 is a perspective view of a carousel incorporated in a 45° corner base.

The invention is illustrated, except in FIG. 17, as a carousel installed in a cabinet 20 under a right angular corner of a conventional counter.

The carousel has a vertically adjustable post 21 rotatably attached to the cabinet base 22 and to the undersurface of the top 23 of the cabinet 20 and located behind a doorway 24. At the upper end of the post 21 there is an assembly, generally indicated at 25, consisting of a hub 26 releasably secured to the post and a series of equally spaced radial arms 27 which are separated by webs 28. Each arm 27 has angularly disposed ends 29 with the ends 29 of adjacent pairs of arms parallel.

The arms 27 are spaced and arranged to provide five spaces, four of which accommodate and hold the upper ends of four containers, generally indicated at 30, of the same height and of the same cross sectional size and shape with each container typically designated to receive a particular type of trash. The bottoms of the containers 30 rest on a tray 31 axially secured to the post 21 and provided with a peripheral rim 32. The fifth space is for a door, generally indicated at 33, having two sections 33A and 33B, secured together at right angles.

Figures 6, 6A, 7, 8:
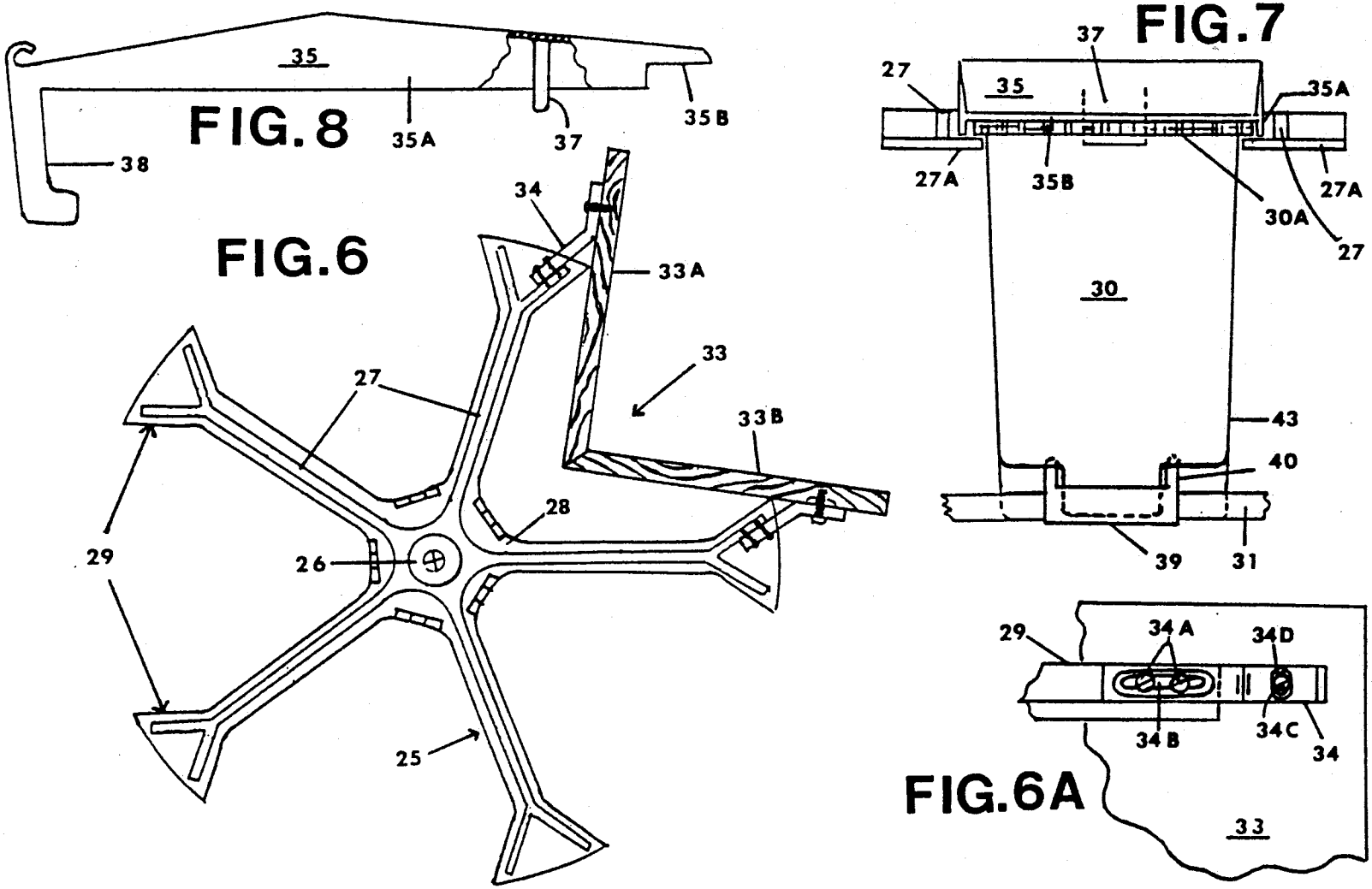
FIG. 6 is a plan view of the radial arm assembly with the door of the corner cabinet adjustably connected to two adjacent arms.
FIG. 6A is a fragmentary view of one of the arms and its adjustable connections with one section of the door.
FIG. 7 is a view of a container as seen from the front showing the two arms and the tray by which it is held.
FIG. 8 is a partly sectioned side view of a cover.
Figure 10:
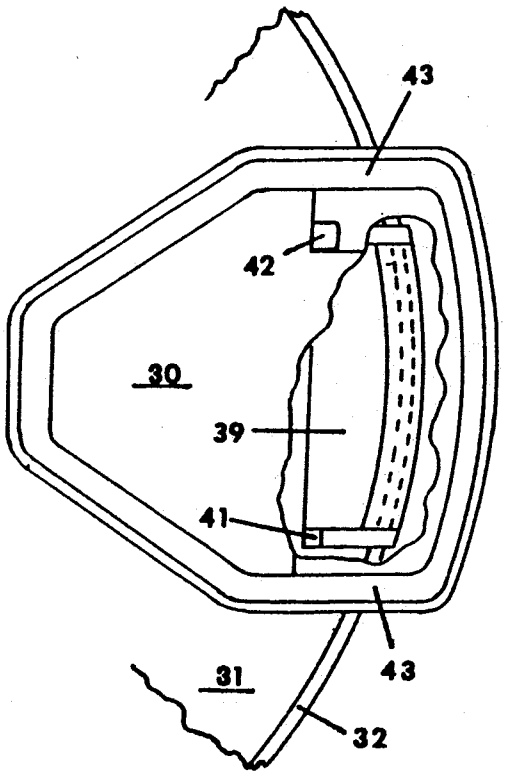
FIG. 10 is a partly sectioned plan view of the container of FIG. 9.
Figure 9:
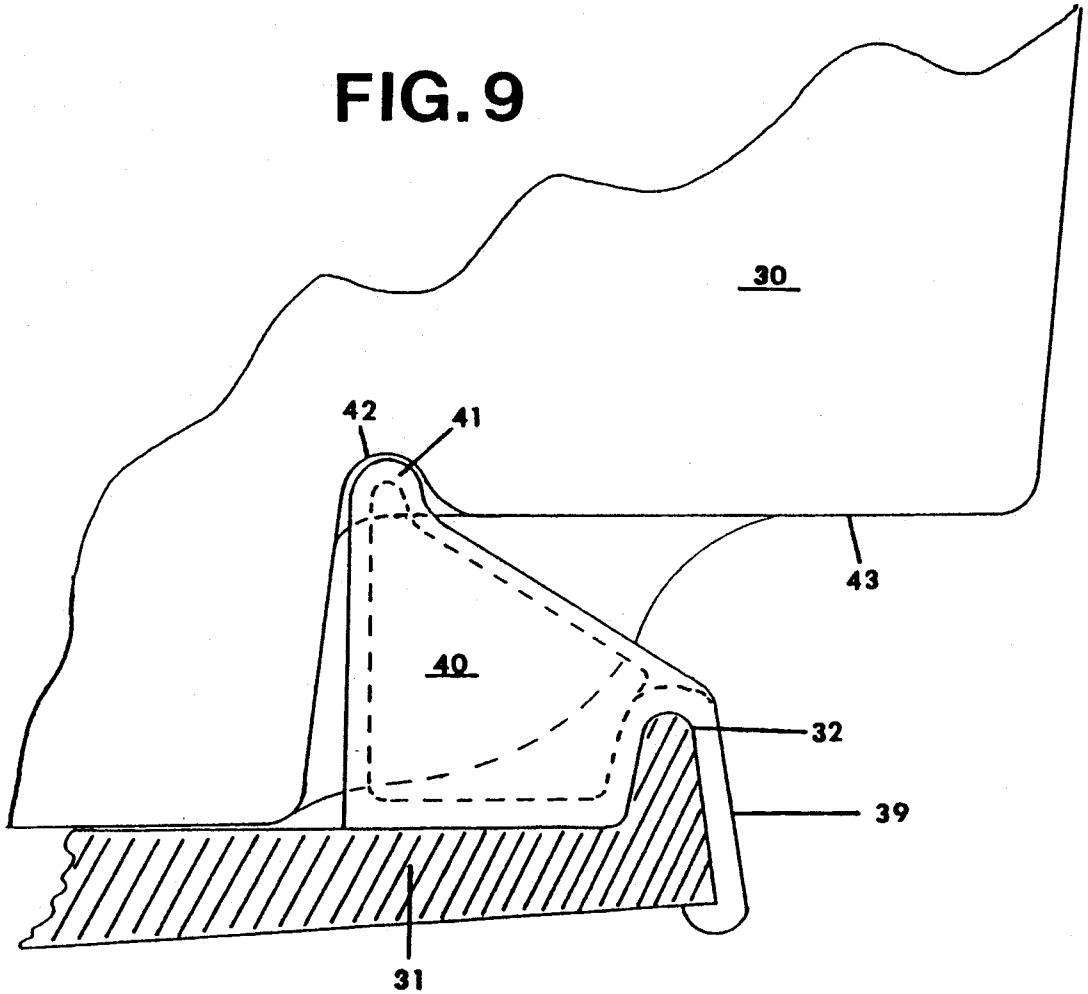
FIG. 9 is a fragmentary side view, on a substantial increase in scale, of the bottom part of a container illustrating the interengageable portions thereof and of the tray.
Figure 12:
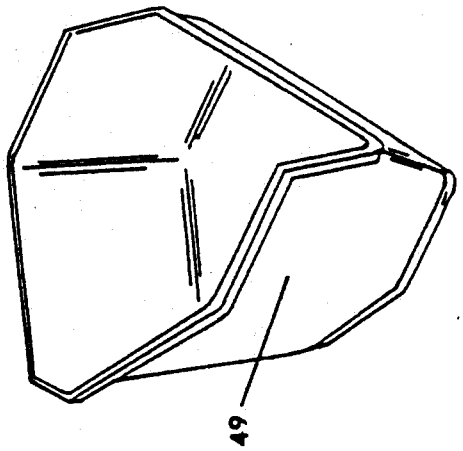
FIG. 12 is a perspective view of one type of container to be supported by the shelf.

The door sections 33A and 33B are connected to the arms 27 by which the sections are to be held by angular brackets 34, see FIGS. 6 and 6A. The inner end of each bracket 34 is adjustably anchored to the appropriate one of the arm ends 29 as by means of two bolts 34A extending through a lengthwise slot 34B with both bolts spaced from the ends of the slot 34B and from each other thus enabling the position of the door 33 relative to the post 21 to be adjusted. The other ends of the brackets 34 are secured to the appropriate door section by a single bolt 34C extending through a vertical slot 34D enabling the camber of the door 33 to be easily adjusted.

It will be apparent that the maximum distance between each pair of arms is dictated by the width of the doorway 24 and that a container can have a greater volumetric capacity by increasing its depth within the limits imposed by the cabinets while maintaining its width as less than that of the doorway. The present invention takes advantage of that obvious construction but provides the outer ends of the arms 27 with angular, oppositely disposed ends 29 to maximize the lateral support of the upper ends of such containers as the containers 30.

A feature of the invention is that each container 30 may be provided with a cover 35 and may be tilted outwardly through the doorway 24 when the post 21 has been turned to place the door 33 under the counter. The covers 35 are pivotally connected as at 36 to the assembly 25, preferably and as shown, to the webs 28 between the pairs of arms. Each cover 35 is shaped and dimensioned to fit between an adjacent pair of arms 27 and over the open end of the subjacent container 30 and is provided, adjacent its front or outer end, with an interior, depending lug 37 dimensioned to extend downwardly into the open containers. The containers 30 have lips 30A marginally of their open ends and each arm 27 has shoulders 27A extending along both of its sides with the container lip 30A closely overlying the shoulders 27A. The front of the cover rests on the container lip 30A with the sides 35A of the cover 30 fitted over the adjacent portions of the container lip 30A and thus a guiding function as a container 30 is entered between a pair of arms 27.

Once a container 30 is in the doorway 24, it is partly exposed but even if uncovered, depositing trash therein is made easier if the exposed area is substantially increased as by tilting the container outwardly with its bottom held against slipping rearwardly.

The bottoms of the containers 30 and the supporting tray 31 are provided with interengageable portions, presently to be detailed, which are effective to hold the bottom of each container 30, when at the doorway 24, in place even while that container is being tilted by pulling the upper part thereof outwardly. When that container has ben tilted outwardly to a predetermined extent, the cover lug 37 is engaged by the rear end of the container. As the cover 35 is held by its connections with the arm assembly 25, the container is almost completely uncovered when held by the lug 37 so that material to be disposed is easily deposited therein, at the same time, the cover is tipped slightly upwardly.

If the tilted container is to be removed, the cover is manually lifted to place its lug 37 out of contact with the container 30 so that the container may then be lifted from the carousel thus disengaging the portions of the container and the tray by which the container bottom had been held.

Figure 1:
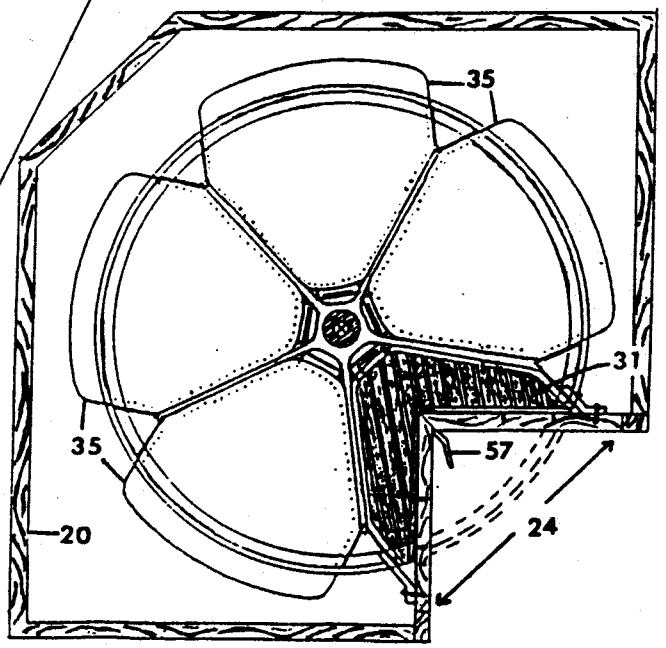
FIG. 1 is a plan view of a carousel installed in a cabinet for a 90° corner base.
Figure 2:
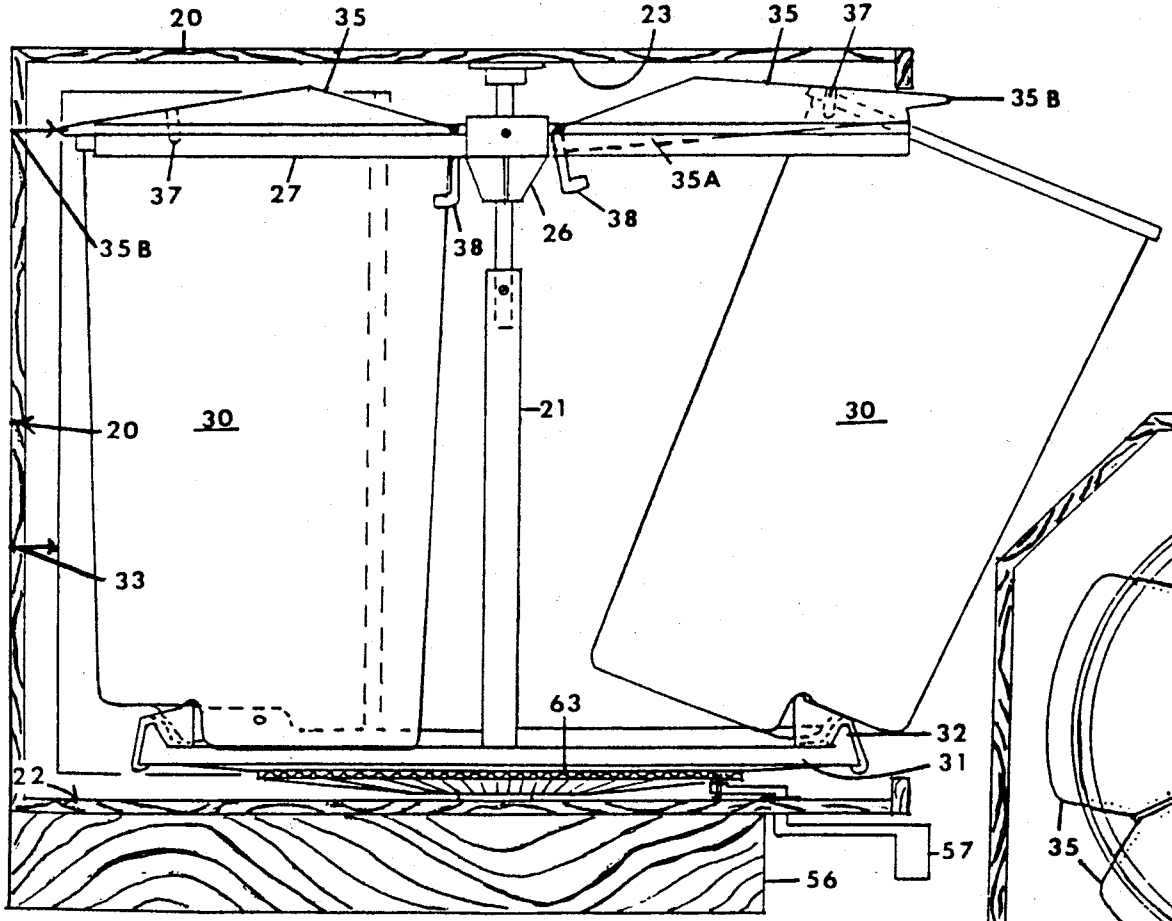
FIG. 2 is a side view of the carousel, on an increase in scale, with two containers, their covers and radial arms omitted better to show one container closed by its cover and another container in the doorway with its cover raised.

It will be noted, see FIGS. 2 and 8, that at the rear or inner end of each cover 35, there is a depending arm 38 which, when a subjacent container 30 is in an upright position in the carousel, is so held thereby that the cover is securely seated on the open end of that container. As the cover 35 is raised during the tilting of the container 30, the arm 38 is swung forwardly away from the post 21 to be again engaged when the outwardly tilted container 30 is pushed back into its upright position, thus reseating the cover 35.

The tray 31 is shown as provided with clips 39 which are caught over the rim 32 thereof with each clip 39 having laterally spaced side walls 40 which rest on the tray 31. The side walls 40 are inclined upwardly and rearwardly and each terminates in a bearing 41 protruding above the tray rim 32. The bearings 41 enter downwardly opening sockets 42 spaced inwardly of the sides of the forward portion of the bottom of the container being seated on the tray 31. The forward portion is so formed relative to the remainder of the container bottom, that it rests on the inclined side walls 40 of the clip 39 when the container is tilted outwardly. It will be seen from FIG. 2 that the sockets 42 and bearings 41 still serve to hold the bottom of the tilted container 30 against sliding rearwardly and they and the side walls 40 provide a secure seat for the container bottom, holding it at the same angle as is established by the lug when in holding with the container.

When a container 30 is to be placed through the doorway 24 into the carousel, its bottom end is placed on the tray 31. With the exposed cover 35 raised so that its lug 37 will not contact the container 30 as it is pushed rearwardly, the container is returned to its upright position with its open end closed by the cover.

Figure 13:
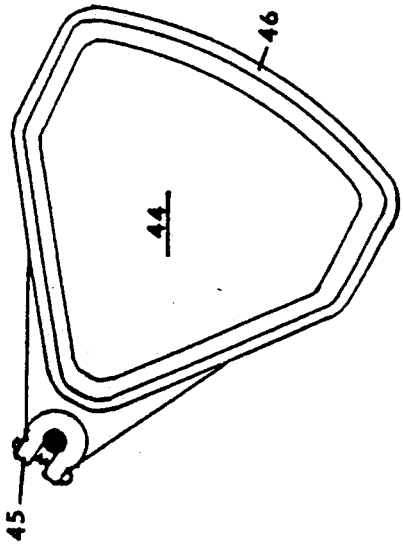
FIG. 13 is a plan view of the shelf detached from the post.
Figure 11:
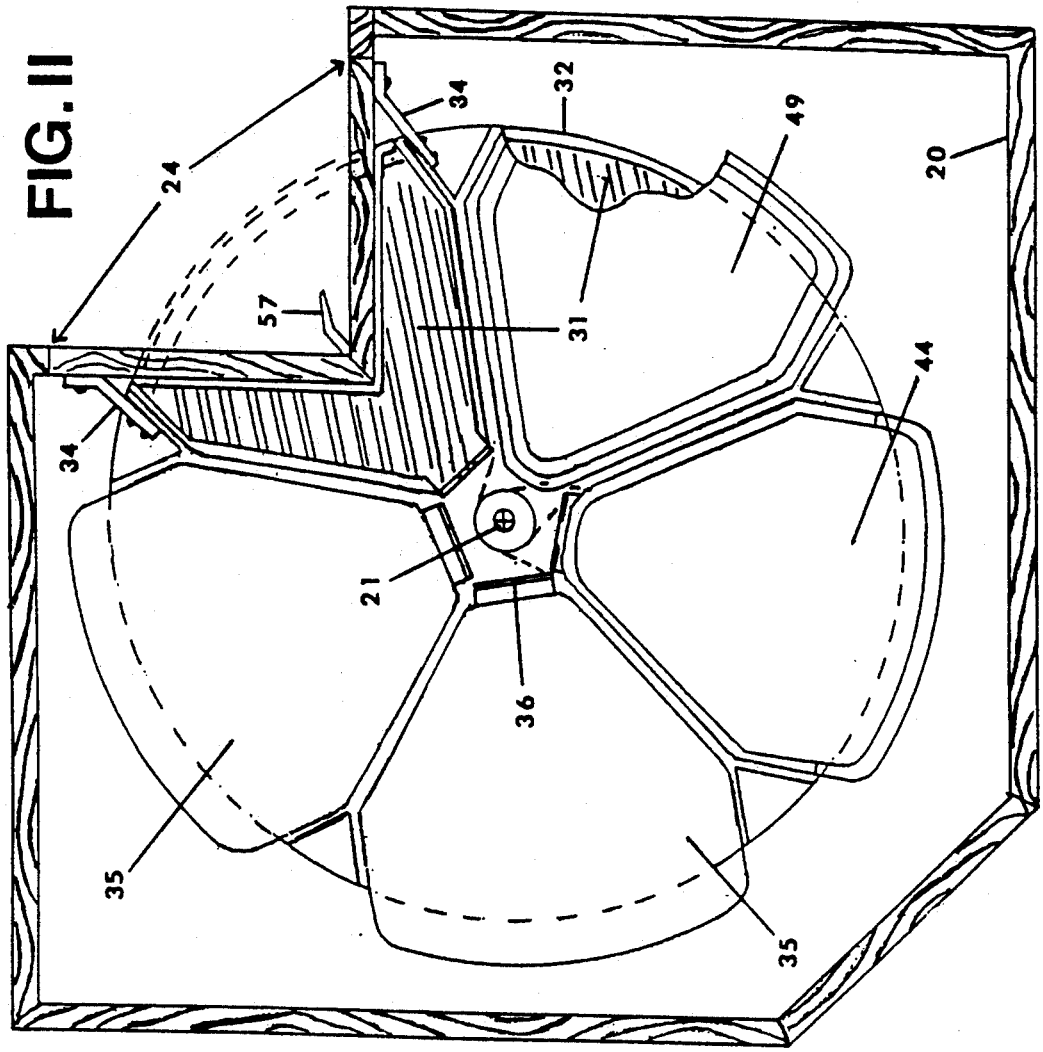
FIG. 11 is a view, generally similar to FIG. 1 with the container supporting structure including a shelf detachably and adjustably connected to the post.
Figure 15:
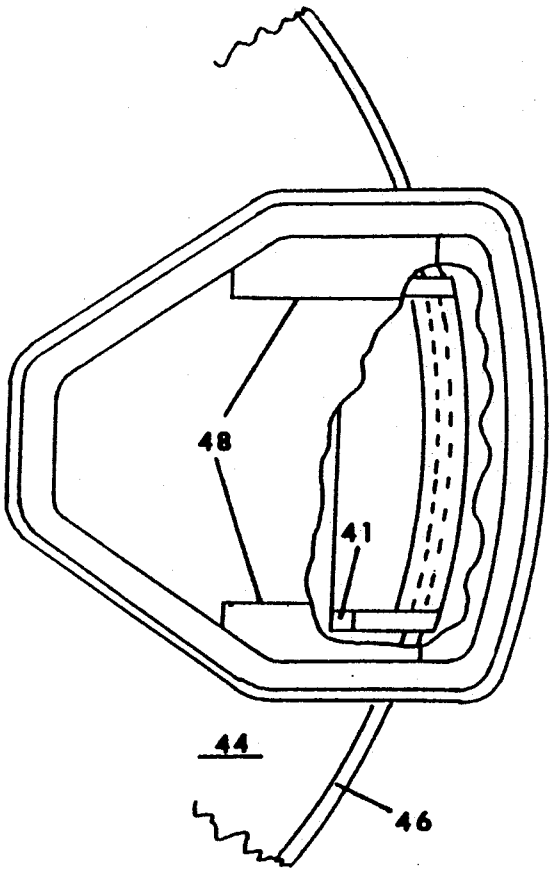
FIG. 15 is a fragmentary view, similar to FIG. 10, with the bottom of the garbage container partly broken away.

The invention permits the use of shorter containers of the same cross sectional size and shape as the containers 30. For their use, shelves 44 are provided and each has a clamp 45, see FIG. 13, by which it may be detachably secured to the post 21 and the shelves 44 have marginal rims 46.

Such containers may be for various use and may or may not require covers. A container for use in storing garbage is generally indicated at 47 and as it is to be covered, the shelf 44 on which the container 47 is seated supports it with the open end thereof fitted between a pair of arms 27 and closed by a cover 35. In order that the container 47 may be tilted outwardly to receive garbage or to be removed, the rim of the shelf 44 is provided with a clip 39 and the bottom of the container 47 has a recess 48 between the ends thereof having forward sockets 49 to receive the bearings 41 of the clip.

Because of the decrease in height of the container 47, it can not be tilted outwardly to the necessary extend as its rearward or inner end would contact the top 23 of the cabinet 20. For that reason, the recess 48 is of such a length that the container 47 may be pulled forward sufficiently to enable the container 47 to be tilted in the manner of the containers 30, the bearings 41 then engaging the rearward end 50 of the recess 48.

Figure 14:
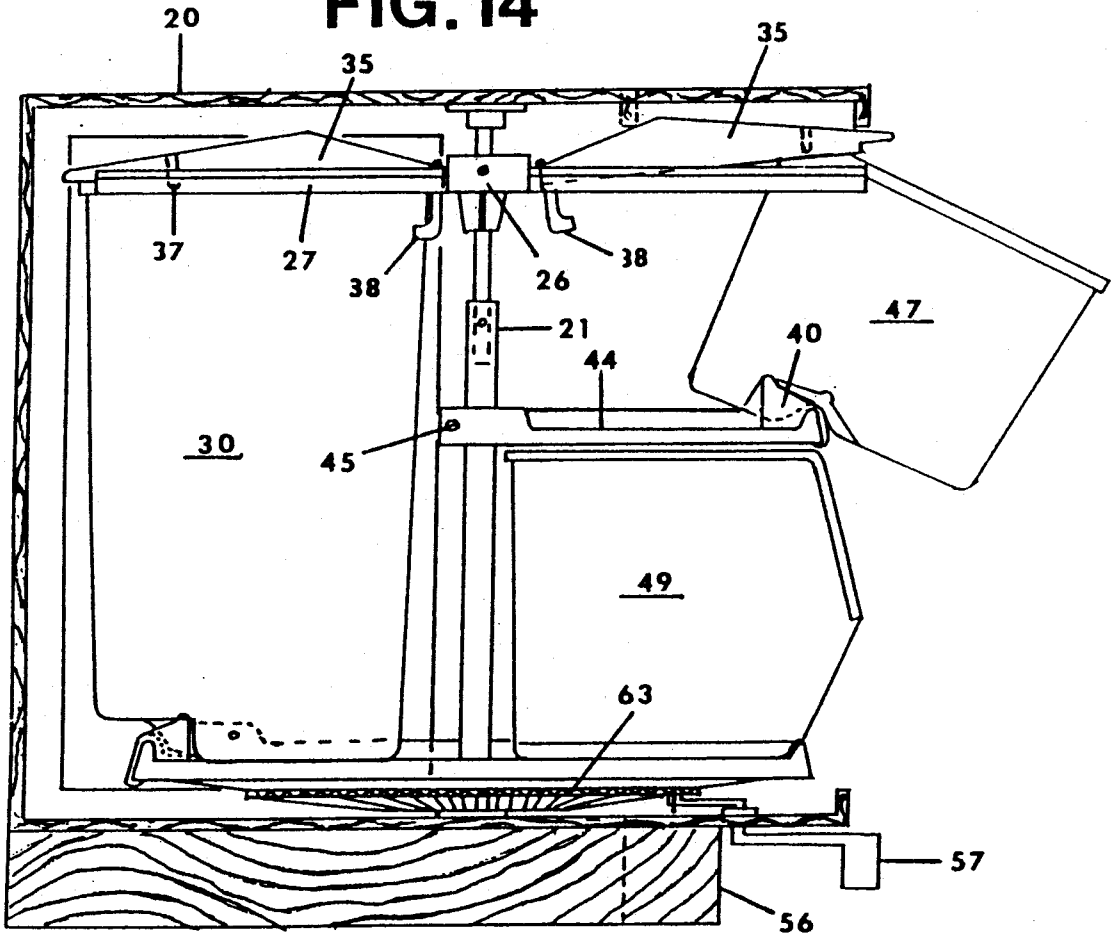
FIG. 14 is a view similar to FIG. 2 but with a shelf in support of a container, such as a garbage container, tilted outwardly and opened.
Figure 16:
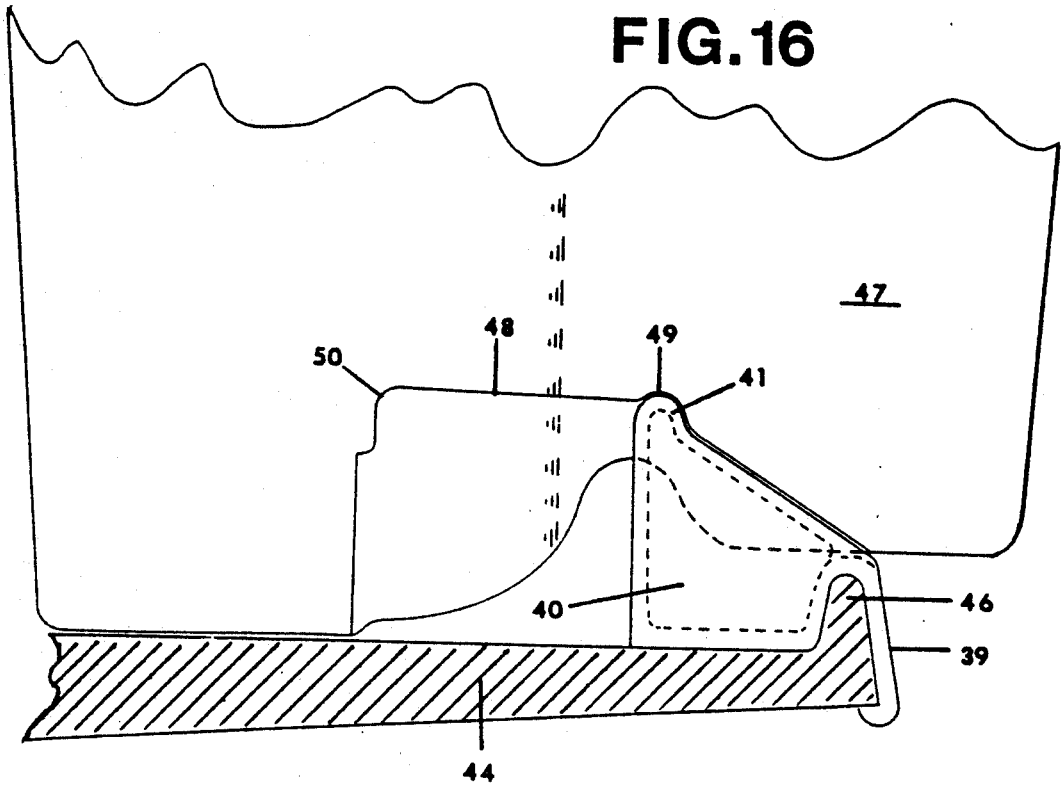
FIG. 16 is a fragmentary side view of the bottom part of the garbage container and the shelf.

With the shelf located as shown in FIG. 14, a container such as the container 47A, shown as supported by the tray 31 but which could alternatively be supported by the shelf 48, is of an open top type also partly open at the front thereof.

In FIG. 17, the carousel is shown as installed in a 45° corner base cabinet 51 having a hinged door 52. In this type of installation, the carousel is entirely under the counter 53, the carousel now supporting five containers 30.

While with the door of either type of installation open, the carousel may easily be turned to expose a particular container. It may, however, be preferred that the post be turned by a foot actuated mechanism.

A mechanism for that purpose is illustrated in FIGS. 2-5 and has a pivot 54 extending through a vertical sleeve 55 located outside the kick plate 56. The pivot 54 is provided with an arm 57 exposed for engagement by a foot. A spring 58 is held tensioned between the sleeve 55 and the pivot 54 and an actuator 59 is secured to the pivot 54. The pivot and the actuator having complementary inclined cam surfaces 60 by means of which, movements of the arm 57 by a foot serve to swing and cam the actuator upwardly. The actuator 59 supports a pawl 61 conventionally provided a spring 62, is engageable with the radially corrugated plate 63 secured to the undersurface of the tray 31. Thus, by swinging the arm 57 in one direction, the spring 58 is compressed and the pawl 61 brought into post turning contact with the plate 63 with the arm 57 spring biased to return when disengaged from the foot by which the turning of the post 21 was initiated.

From the foregoing, it will be apparent that carousels in accordance with the invention are well adapted for use in recycling household wastes.

I claim:

1. A carousel for use with a group of containers and for installation in a cabinet under a counter behind an opening in the front wall of the cabinet, the cabinet having a base, said carousel including a post to be rotatably connected to the base of the cabinet and to the undersurface of the counter, an assembly connected to the upper end of the post, the assembly including a series of outwardly extending radial arms so spaced and arranged that adjacent arms can accommodate between them a container of an appropriate cross sectional size, shape and height and hold the container against moving laterally and means underlying the arms and connected to the post and shaped and dimensioned to hold the bottom of the containers against outward movement.

2. The carousel of claim 1 in which each container has an open upper end a bottom wall and front and rear ends, and the carousel has at least one cover, the cover shaped and dimensioned to fit between a pair of arms and over the subjacent container to close the open end thereof, the interior of the cover is provided with a depending lug dimensioned to enter the outer end of the container, and the cover is pivotally connected to the assembly in a manner such that, when the container is pulled forwardly and tilted outwardly towards the opening with the lug in engagement with the rear end of the container, the cover is tilted upwardly and the container is held tilted away from the cover.

3. The carousel of claim 2 in which the cover is provided with a depending arm at the rear end thereof against which the rear end of the container is seated when the bottom wall of the container is seated on the underlying supporting means and which is exposed in the path of the rear end of the container when the container is returned from the tilted position thereof then to pull the cover downwardly onto the container closing position thereof.

4. The carousel of claim 1 in which a radially corrugated pan is axially mounted on the post below the tray, an arm below the cabinet base extends outwardly of the counter and has a pivot extending vertically upwardly through and is rotatably supported by the base of the cabinet, an actuator, means connecting the actuator to the pivot above the base, and a pawl mounted on the actuator and engageable with the corrugations to effect the turning of the post when the exposed end of the arm is swung in one direction.

5. The carousel of claim 4 in which the connection includes coacting cam surfaces between the pivot and the actuator operable to raise the pawl into turning contact with the corrugations as the arm is swung in said one direction.

6. The carousel of claim 1 and a shelf detachably attached to the post in a position to support a container shaped and dimensioned to be accommodated between a pair of arms and of a height less than the distance between the tray and the arms.

7. The carousel of claim 1 in which the containers are of the type having marginal lips and the arms have laterally extending shoulders with the distance between the shoulders and the container supporting means such that the marginal lips of a seated container closely overlie the subjacent shoulders.

8. A carousel for installation in a cabinet under a counter behind an opening in the front wall of the cabinet, the cabinet having a base, said carousel including a group of open containers having bottom walls including forward and rearward portions, said carousel including a post to be rotatably connected to the base of the cabinet and the undersurface of the counter, an assembly including a series of outwardly extending radial arms so spaced and arranged that adjacent arms can accommodate between them a container of an appropriate size, shape and height and hold the container against moving laterally, supporting means underly the arms and connected to the post and shaped and dimensioned to hold the bottoms of the containers against outward movement, the carousel has at least one cover, said cover shaped and dimensioned to fit between a pair of arms and over a subjacent container, the interior of the cover provided with a depending lug dimensioned to enter the outer extremity of the open end of the container, the cover pivotally connected to the assembly in a manner such that, when the container is pulled forwardly it is tilted outwardly towards the opening with the lug in engagement with the rear end of the container, the cover is tilted upwardly and the container tilted away from the cover, and the bottom of each container and the container supporting means including portions in engagement and operable to prevent other than tilting movements and during the tilting of a container holding the container bottom from sliding inwardly, the forward portion of the container bottom disposed relative to the rear portion thereof to permit such tilting.

9. The carousel of claim 8 in which the interengaged portions of the containers and the container supporting means consists of downwardly opening sockets in the container bottoms between their outer and inner ends, and the container supporting means include bearing spaced inwardly of and extending upwardly above the periphery thereof.

10. The carousel of claim 9 in which the portion of each container bottom forwardly of the sockets is shaped and dimensioned to rest on the periphery of the container supporting means when the lug of the cover is in holding contact with the rear of the open end of the container.

11. The carousel of claim 10 in which the container supporting means include clips detachably secured to the periphery thereof, each clip includes bearing means and is so shaped and dimensioned that a portion of a container bottom rests on the clip when the lug of the cover is in holding contact with the rear of the open end thereof.

12. The carousel of claim 8 in which the container supporting means includes a shelf detachably attached to the post in a selected position above the remainder thereof, the bottom of the container has a recess in the forward end of which the downwardly opening sockets are located, the recess of sufficient length to enable the container to be slid forward until the bearings contact the opposite end of the recess, the container then free to be tilted.

13. The carousel of claim 8 in which each container has an outwardly disposed lip surrounding the open end thereof, each arm has a shoulder extending lengthwise of each side thereof and underlying corresponding portions of the lip of the container when positioned upright of the carousel, and the cover has side walls which fit over subjacent portions of the lip and a front wall resting on subjacent portions of the lip.

* * * * *